US007927227B2

(12) United States Patent
Radcliffe et al.

(10) Patent No.: US 7,927,227 B2
(45) Date of Patent: Apr. 19, 2011

(54) GOLF SWING ALIGNMENT TRAINING DEVICE

(75) Inventors: Thomas L. Radcliffe, Coeur D'Alene, ID (US); Judith Carpenter, Hayden, ID (US)

(73) Assignee: Judith M. Carpenter, Hayden, ID (US)

( * ) Notice: Subject to any disclaimer, the term of this patent is extended or adjusted under 35 U.S.C. 154(b) by 30 days.

(21) Appl. No.: 12/331,435

(22) Filed: Dec. 10, 2008

(65) Prior Publication Data

US 2010/0144458 A1 Jun. 10, 2010

(51) Int. Cl.
*A63B 69/36* (2006.01)

(52) U.S. Cl. ..... 473/270; 473/218; 473/273

(58) Field of Classification Search ..... 473/219, 473/257, 261–266, 270–273, 278, 279
See application file for complete search history.

(56) References Cited

U.S. PATENT DOCUMENTS

| | | | | |
|---|---|---|---|---|
| 2,169,407 | A * | 8/1939 | Crowley | 473/272 |
| 3,229,981 | A | 1/1966 | Taber | |
| 3,244,421 | A | 4/1966 | Hanna | |
| 3,580,584 | A * | 5/1971 | Trosko | 473/218 |
| 4,384,718 | A | 5/1983 | Cachola | |
| 4,544,161 | A | 10/1985 | Guendling | |
| 4,583,739 | A | 4/1986 | Kabbany | |
| 4,736,952 | A * | 4/1988 | Taft et al. | 473/218 |
| 5,246,234 | A | 9/1993 | Zambelli | |
| 5,350,177 | A * | 9/1994 | Furbush, Jr. | 473/218 |
| 5,362,060 | A | 11/1994 | Hinson | |
| 5,415,407 | A | 5/1995 | Beatty | |
| 5,435,727 | A | 7/1995 | Dobson | |
| 5,527,037 | A * | 6/1996 | Matsumoto | 473/218 |
| 5,944,613 | A | 8/1999 | Dubois | |
| 6,077,168 | A | 6/2000 | Huang | |
| 6,086,483 | A | 7/2000 | Brown | |
| 6,726,576 | B1 | 4/2004 | Froggatte | |
| 6,752,724 | B1 | 6/2004 | Schumacher | |
| D529,568 | S | 10/2006 | Gauer | |

OTHER PUBLICATIONS

Align-Drive product information; author unknown, publication date unknown. Diagram and photgraph device sold as "Align-Drive" obtained from website www.align-drive.com at a date prior to filing of this application. This device is believed to be the same as taught and claimed by DuBois 5,944,613; therefore, this cite is believed to be cumulative to DuBois.

(Continued)

*Primary Examiner* — Nini Legesse
(74) *Attorney, Agent, or Firm* — Oleh Weres

(57) ABSTRACT

Golfers need and desire to practice and perfect their golf swings, and proper alignment of the golfer's body and the arc that the head of club travels are critical in this regard. The golf swing alignment training device provided allows golfers of different height and body proportions, and using a variety of different golf clubs to practice and perfect their swing. The device comprises a stance rule changeably marked to indicate proper location of the golfer's feet as required using different clubs, a connecting shaft perpendicular to the stance rule that can be moved as needed for clubs of different length, a swing guide governing the direction of the golfer's swing and the shape of its arc, a club face orientation indicator that can be adjusted to indicate proper club face orientation for different shots, and a ball position indicator which properly locates the ball in relation to the device and the golfer's body. The device is of simple, rugged construction, easily adjustable as needed by golfers of different size and body proportion, and a single device can be used by right or left handed golfers, and even by children.

12 Claims, 4 Drawing Sheets

OTHER PUBLICATIONS

StanceMinder product information; author unknown, publication date unknown. Brochure provided with a device sold as "StanceMinder" which was purchased at a date prior to filing of this application. This device is believed to be an improved version of the device taught and claimed by Hinson 5,362,060.

* cited by examiner

GOLF SWING ALIGNMENT TRAINING DEVICE

BACKGROUND OF THE INVENTION

1. Field of Invention

A golf swing alignment training device of simple construction is provided. The device is easily adjustable as may be required for use by golfers of different height and body proportions, and using a variety of different clubs.

2. Prior Art

Numerous devices to assist golfers in practicing and perfecting their swings are known, as exemplified by the ones described following.

Dubois U.S. Pat. No. 5,944,613 teaches a golf stance and ball alignment practice aid comprising a horizontal tube with marks indicating proper positioning of the feet for different ranges of club numbers, and a tapered shaft inserted transversely through one of preferably three holes of different diameter drilled through the shaft perpendicular to its axis and parallel to the ground. The different placement of the tapered shaft in each of the three holes allows for clubs of different length, but there is no way to adjust the device for different proportions of the golfer's body, and no guidance is provided for the direction of the swing, proper shape of the arc of the swing, or proper orientation of the club face.

Hinson U.S. Pat. No. 5,362,060 teaches a stance minder for golfers comprising an elongated, slotted base member with two elongated, curved foot position indicators pivotally attached thereto, one of which can be moved along the slot in the base member as needed to properly fix the distance between the golfer's feet when using different clubs, and an elongated, slotted position reminder affixed to the base member in substantially perpendicular orientation thereto, and adjustable by movement of a clamping assembly along the slots in the two elongated members as needed to allow for use with different clubs. The ball is placed at the distal end of the position reminder, and a mark painted on the surface of the position reminder indicates proper orientation of the club face for a straight shot.

A modified version of Hinson's device sold as "Stance Minder™" further comprises an elongated, straight-edge swing guide attached to the distal end of the position reminder (now called ball positioner). Unlike Hinson's earlier device, the three elongated members are rigidly fixed perpendicular to each other, and the slotted base member (now called target guide) has a ruler printed on it to indicate proper location of the position reminder and foot guides along its length. The Stance Minder™ device is constructed of numerous plastic parts of complicated form and comes in two models for use by right and left handed golfers; the same device cannot be used by both.

Huang U.S. Pat. No. 6,077,168 teaches a swing-practice device for golf substantially similar to Hinson's earlier device including foot position indicators, but further comprising an elongated, straight-edge swing guide attached to the position reminder near to its distal end, and also having a ball mount which is a rigid spoon-like device attached to and extending beyond the distal end of the position reminder which performs the function of a golf tee. As in Hinson's earlier device, the three elongated members are slotted and adjustable in relation to each other by movement along the slots, and are fixed in position using to screw clamping assemblies.

SUMMARY OF THE INVENTION

A golf swing alignment training device is provided, comprising:

(1) An elongated, rigid, substantially straight stance rule member (hereinafter simply "stance rule") with marks changeably applied to indicate proper location of the golfer's feet when using different clubs (the term "feet" should be understood to mean prosthetic feet as well as natural feet);

(2) A connecting shaft member (hereinafter simply "connecting shaft") perpendicular to the stance rule and movable in relation to the stance rule to allow for clubs of different length and the different body proportions of individual golfers;

(3) An elongated swing guide member (hereinafter simply "swing guide"), preferably rigid, which guides the golfer in the direction of his or her swing (hereinafter simply "his/her"; "his or her" is to be understood), and has a curved edge which guides the golfer in shaping the proper arc of his/her swing;

(4) A club face orientation indicating member (hereinafter simply "club face orientation indicator") which indicates the proper orientation of the club face as required for hooks and fades as well as straight shots; and (5) A ball position indicating member (hereinafter simply "ball position indicator") which precisely indicates the proper location of the ball in respect to the golf swing alignment training device and the golfer's body.

DESCRIPTION OF INVENTION

Objects and Advantages

Unlike the prior art devices, our device (1) Can be used by both right and left handed golfers without modification;

(2) Can be used by children;

(3) Guides the golfer in properly shaping the arc of his/her swing as well as the direction;

(4) Guides the golfer in aligning the club face for hooks and fades as well as straight shots;

(5) Comprises just a few parts, none of which are fragile or complex;

(6) Can easily be stored and transported in a single club tube of a golf bag; and (7) Can be repaired on the course if accidently struck and damaged.

DRAWING FIGURES

FIG. 1 shows the complete golf swing alignment training device in plan view, and in relation to the golfer's feet and the golf ball.

FIG. 2 shows the complete golf swing alignment training device in a slightly simplified isometric view.

FIG. 3 shows swing guide 12 and ball position indicator 18 in relation to golf ball 24 and the desired arc 25 of the golfer's swing.

FIG. 4 shows the club face orientation indicator 16 in detail.

DESCRIPTION OF THE DRAWINGS

The golf swing alignment training device, illustrated in a preferred embodiment in FIG. 1, is placed on the ground with the pointed end 10A of stance rule 10 pointing in the direction of the desired swing. The device essentially comprises stance rule 10, connecting shaft 14, and swing guide 12. The preferred embodiment further comprises ball position indicator 18 and adjustable club face orientation indicator 16.

Figure 1:
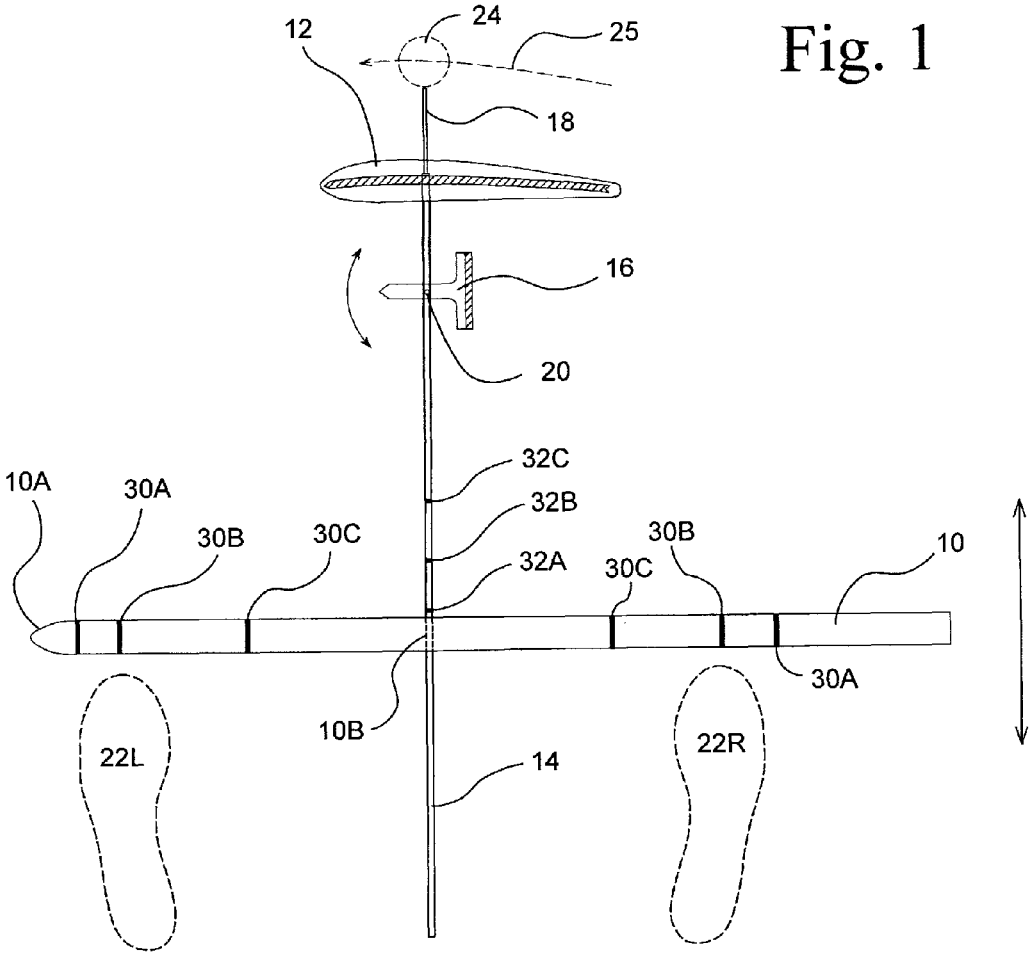
FIG. 1 illustrates placement of the golf swing alignment training device on the ground as it would be used by a right handed golfer, but it can easily be reconfigured for use by a left-handed golfer as described below.

Pairs of marks 30A, 30B and 30C are applied to stance rule 10 to indicate where the golfer is to position his/her feet 22L and 22R, each pair of marks corresponding to a different type of golf club. The precise locations of the marks depend on the height and physical proportions of the golfer as well as the club employed. Connecting shaft 14 passes with a snug fit through hole 10B drilled through stance rule 10 horizontally and in a direction substantially perpendicular to the length of stance rule 10, allowing it to be slid up-and-down along connecting shaft 14 while resisting unintentional movement. Marks 32A, 32B and 32C are applied to connecting shaft 14 indicating proper position of connecting shaft 14 in relation to stance rule 10 as appropriate to the length of club used and golfer's stature and build.

Marks 30A, 30B and 30C most preferably comprise pieces of tape or stickers which reliably adhere to the surface of stance rule 10, but can easily be removed and/or repositioned if necessary without damage to the surface of the stance rule. These marks can also be applied using an ink that can easily be removed using an appropriate solvent (for example, isopropyl alcohol) but which will not easily be rubbed-off or be smeared by moisture. Marks 32A, 32B and 32C are most preferably applied using ink with the properties noted. While three sets of marks will most often be necessary and sufficient, any desired number of marks may be applied.

Stance rule 10 preferably is made of polypropylene sheet ½ inch thick, with approximate dimensions 1.25 inches wide and 33 inches long, but other materials and dimensions can of course be employed. Polypropylene is preferred for this application because it can easily be machined or injection molded, and provides good impact resistance and excellent moisture resistance at low cost. These properties are highly desirable because stance rule 10 will be placed on moist grass, and is likely to be stepped on or kicked. Connecting shaft 14 preferably is made of ¼ inch diameter glass-fiber reinforced polyester rod about 33 inches long, but other materials and dimensions can of course be employed. Glass-fiber reinforced polyester is preferred for this application because it has excellent impact resistance and can be bent without breaking or permanently deforming, highly desirable properties because connecting shaft 14 is likely to be stepped on and possibly struck with a club.

Swing guide 12 is attached to the distal end of connecting shaft 14. Swing guide 12 indicates the direction of the swing, and at least its upper edge is shaped with a contour parallel to the desired arc of the swing 25 as seen by the golfer.

Ball position indicator 18 is attached to and extends from swing guide 12, and the golf ball 24 is placed at the end of ball position indicator 18 almost touching it.

Club face orientation indicator 16 is attached to connecting shaft 14 in a manner that allows it to rotate with moderate resistance about a vertical fastener; that is, club face orientation indicator 16 is easily repositioned but will stay in place otherwise.

Figure 2:
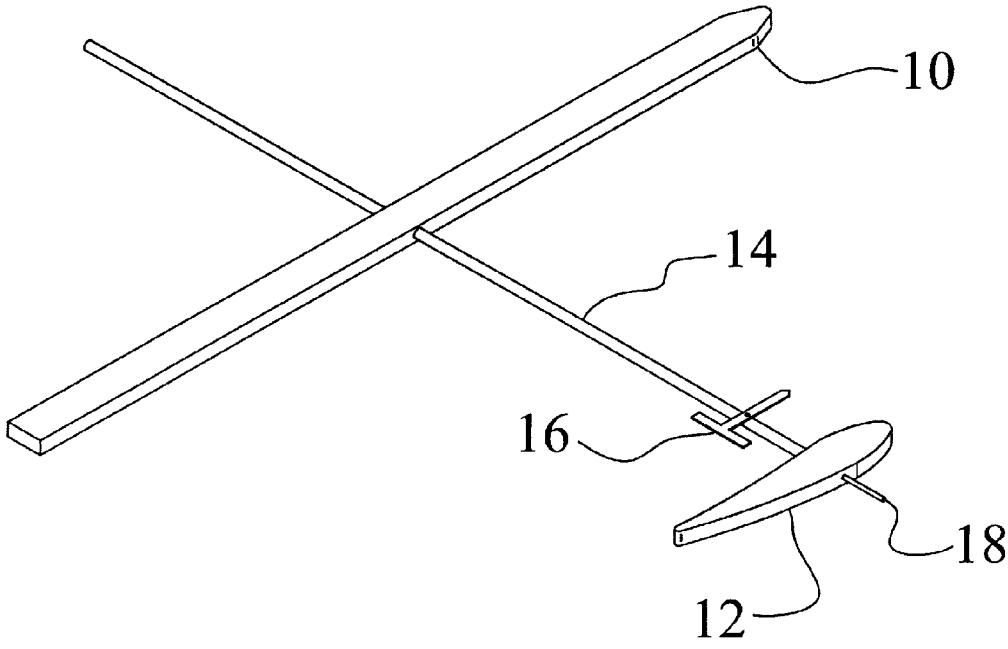

FIG. 2 shows the complete golf swing alignment training device in a slightly simplified isometric view.

Figure 3:
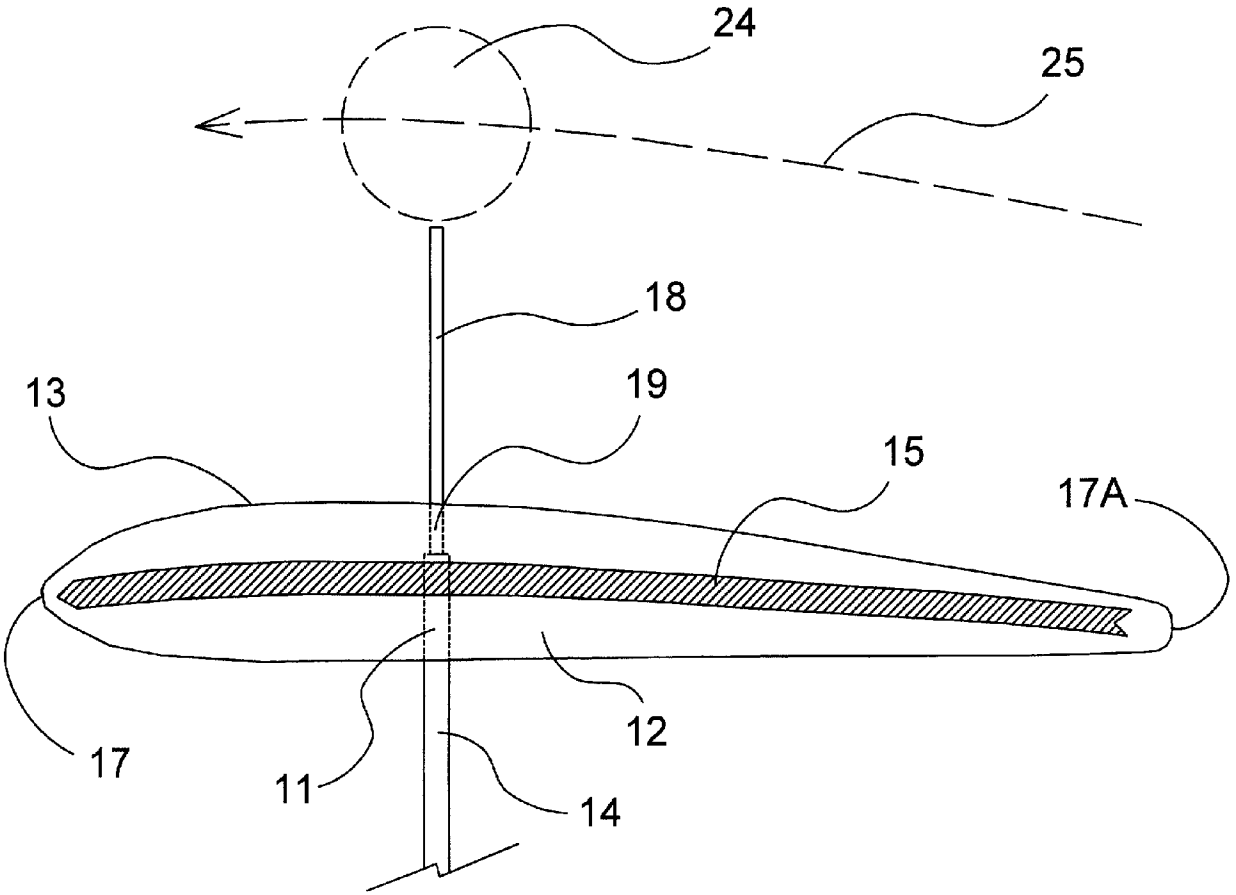

FIG. 3 shows swing guide 12 and ball position indicator 18 in detail. Swing guide 12 is mounted at the end of connecting shaft 14, which is inserted into hole 11 drilled into the body of swing guide 12 in a horizontal direction. The diameter of hole 11 provides a snug fit so that connecting shaft 14 will stay in place once inserted, but can easily be removed to disassemble the device. Optionally, the end of connecting shaft 14 may be threaded and hole 11 correspondingly tapped.

The upper edge 13 of swing guide 12 is contoured to substantially conform to and parallel arc 25 traveled by the center of the face of the club when properly swung. The desired contour of upper edge 13 may be determined by having a skilled golfer or golf instructor strike ball 24 placed directly on the grass as illustrated in relation to our golf swing alignment training device, then tracing the line 25 of the furrow produced through the grass by his or her club. Optionally but preferably, a contrasting streak or arrow 15 having a contour substantially the same as upper edge 13 may be applied to swing guide 12 to reinforce the golfer's perception of the proper arc 25 of his/her swing.

Follow through end 17 of swing guide 12 is pointed to indicate the direction of the swing, and, as illustrated, the overall shape of swing guide 12 should be chosen to reinforce the golfer's perception of the proper direction of the swing. Preferably, the downswing end 17A of swing guide 12 should be rounded to minimize damage in case swing guide 12 is struck by the club.

Swing guide 12 is preferably made of polypropylene ½ inches thick, about 10 inches long, and 1.25 inches wide at its maximum dimension, although other materials and dimensions can of course be used.

Ball position indicator 18 is preferably a piece of small diameter plastic rod, preferably about ⅛ inch in diameter and about three inches long as measured from the edge of swing guide 12. It fits into a snug hole 19 drilled into swing guide 12. The diameter of hole 19 is sized to retain ball position indicator reliably in place, but to allow it easily to be removed when necessary. Hole 19 preferably is coaxial with hole 11.

In use, ball position indicator 18 will often be struck by club and is therefore preferably made of an inexpensive, impact resistant material and can easily be replaced if damaged; for example, polypropylene, high density polyethylene or glass-fiber reinforced polyester.

Figure 4:
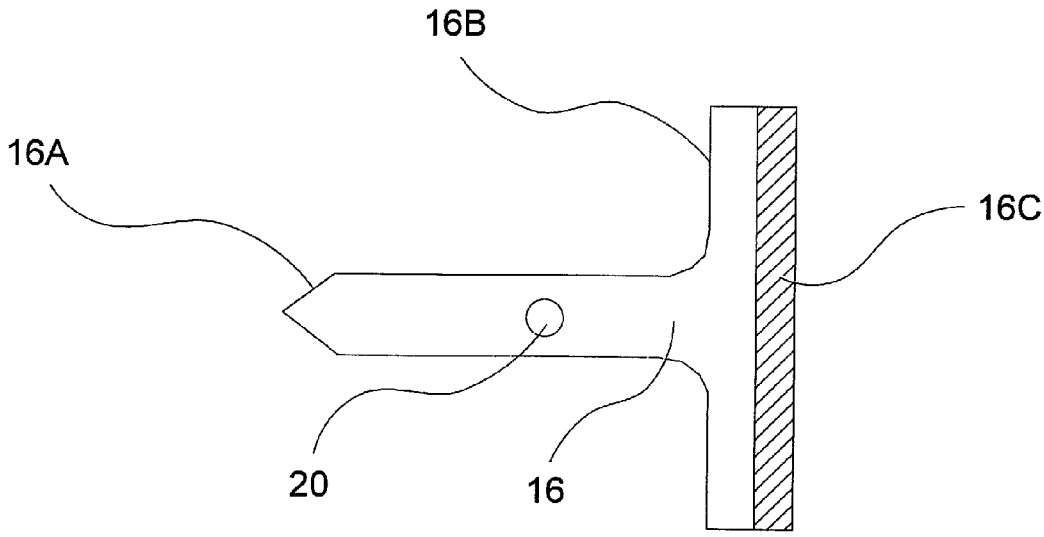

FIG. 4 shows club face orientation indicator 16 in detail.

Club face orientation indicator 16 preferably has a T-shape, with the upper bar 16B of the T used to designate the desired orientation of the club face as in approaches the ball. The golfer's perception of this desired orientation may be reinforced by applying mark or stripe 16C to upper bar 16B. Column 16A of the T is pointed at its end and designates the direction perpendicular to the desired orientation of the club face when it approaches the ball.

Club face orientation indicator 16 is pivotally attached to connecting shaft 14 using a suitable fastener which passes through hole 20 and a corresponding hole (not shown) drilled through connecting shaft 14. Most preferably, the fastener employed is a nylon screw (not shown) together with a two nylon nuts jammed together on the screw.

Operation of the Invention

Before the golf swing training device is used, marks 30A, 30B, 30C, 32A, 32B and 32C should be applied to indicate proper location of golfer's feet 22L and 22R and connecting shaft 14 in relation to slide rule 10 when different clubs are used. These marks should be applied by a golf instructor with reference to the golfer's body proportions and as needed to encourage the correct stance appropriate to the different clubs that will be used.

Stance rule 10 is placed on the ground pointing in the desired direction of the swing. Golf ball 24 is placed nearly touching the tip of ball position indicator 18. Golf ball 24 may be placed on a tee (not shown) if driving from a tee is to be practiced, but is otherwise placed directly on the grass.

Club face orientation indicator 16 is rotationally positioned as needed to assist the golfer in directing the club face at the angle required for a particular type of shot; for example, a hook or a fade would require rotating it about 20 degrees away from the direction perpendicular to connecting shaft 14 in one direction or the other.

Once everything including the golfer's feet and body are properly positioned, the golfer is ready to practice his/her swing.

While the figures appended hereto depict our invention as it would be placed and used by a right handed golfer, our golf swing alignment training device is easily reconfigured for use by a left handed golfer, whereby the same device can be used by either right or left handed golfers, and separate models need not be provided for them. One way to reconfigure the device for use by a left handed golfer would be to simply flip the device over so that the pointed ends of the stance rule and swing guide point to the right, and removing and remounting club face orientation indicator 16 so that it is again on top of connecting shaft 14. Another way to reconfigure it would be to simply rotate stance rule 10 and swing guide 12 through 180 degrees around connecting shaft 14, and rotate club face orientation indicator 16 by about 180 degrees about its fastener.

It is certain that ball position indicator 18 will sometimes be struck by the club, and the golfer should be provided with replacements for ball position indicator 18. It is also possible that club face orientation indicator 16 may be damaged by being stepped on or struck, and the golfer should be provided with a replacement spare for club face orientation indicator 16 as well. In fact, it is more likely that the fastener used to attach club face orientation indicator 16 to connecting shaft 14 will be damaged, and several sets of spare replacement fasteners (preferably nylon screw, washer and nut) should be provided to the golfer. All of these parts can easily be replaced on the course by the golfer his- or herself. It is much less likely that stance rule 10, swing guide 12 or connecting shaft 14 will be damaged if they are made of impact resistant materials as discussed above.

Our golf swing alignment training device can easily be disassembled by removing swing guide 12 and stance rule 10 from connecting shaft 14. These parts (with the smaller parts attached to them) can then conveniently be fitted into a single tube in the golf bag, or into an elongated bag or pouch of similar size.

CONCLUSION AND RAMIFICATIONS

Our invention has been described with reference to the preferred embodiment and some variations thereupon. Modifications and alterations will occur to one skilled in the art upon a reading and understanding of this application. It is intended to include all such modifications and alterations in so far as they come within the scope of the appended claims or the equivalents thereof. For example, the dimensions and exact shape and proportions of the several parts described and illustrated can be changed, and a variety of structural materials known to one skilled in the art can be used in place of the ones recited herein. It is anticipated that the device will be made in a range of sizes to accommodate golfers of different size, including children.

While swing guide 12 preferably is rigid, it may alternatively be made of a soft or flexible material. Connecting shaft 14 may be a square or flat bar or strip instead of a cylindrical rod as illustrated.

Marks indicating proper position of the golfer's feet and proper location of the stance rule along the connecting shaft can be applied in a permanent manner; for example, using permanent ink While marks applied using a suitable ink, tape or stickers are preferred, the desired positions for the golfer's feet 30A, 30B or 30C can be indicated using spring clips applied to stance rule 10 or another kind of mechanical marking device, for example, one or more pairs of mechanical indicators that can be repositioned on rule 10 by sliding them up-or-down along its length. Similarly, the desired position 32A, 32B or 32C of connecting shaft 14 in relation to stance rule 10 can be indicated using one or more mechanical marking devices.

In the claims, the terms "marking devices" is meant to include all such devices known in the art that may be used to indicate the proper location of the golfers's feet and connecting shaft 14 in relation to stance rule 10, including but not limited to ink marks removably or permanently applied, pieces of tape or stickers, and mechanical marking devices including spring clips, sliders, etc. . . . .

While the preferred shape of the club face orientation indicator 16 is a T as shown in the figures, it can have another shape; for example, a simple pointer perpendicular to the club face (that is, the column 16A of the T alone), a bar parallel to the club face (that is, the upper bar 16B of the T alone), or a circle or semicircle with an arrow printed or embossed upon it. Club face orientation indicator 16 can be attached to swing guide 12 instead of to connecting shaft 14.

The invention claimed is:

1. A golf swing alignment training device for use by a golfer having feet and using one of several golf clubs, comprising an elongated, rigid, substantially straight stance rule member, an elongated, rigid swing guide member having an upper edge and a lower edge and disposed in a manner approximately parallel to said stance rule member, and an elongated connecting shaft member connected to said stance rule member and connected to said swing guide member in a manner allowing the distance between said stance rule member and said swing guide member to be varied, and a club face orientation indicating member fastened directly to said connecting shaft member in a manner allowing the orientation of said club face orientation member to be varied, whereby the golfer can adjust the orientation of said club face orientation member to indicate the proper orientation of the club face as may be required to execute a straight shot, a hook, or a fade.

2. The golf swing alignment training device of claim 1 further comprising marking devices changeably applied to said stance rule member, wherein said marking devices are chosen from the class consisting of removable ink marks, pieces of tape and removable stickers, whereby said marking devices can be applied as needed to indicate the proper positioning of said feet by a particular golfer using a particular club.

3. The golf swing alignment training device of claim 2 further comprising at least one marking device changeably applied to said connecting shaft member, wherein said marking device is chosen from the class consisting of removable ink marks, pieces of tape and removable stickers, whereby said marking devices can be applied as necessary to indicate the proper stance of a particular golfer using a particular club.

4. The golf swing alignment training device of claim 2 further comprising a golf ball position indicator member fastened to said swing guide member.

5. The golf swing training device of claim 2 wherein said stance rule member is made of polypropylene, whereby said stance rule member will have good impact resistance and excellent moisture resistance.

6. The golf swing alignment training device of claim 1 wherein said upper edge of said elongated swing guide member is contoured to substantially conform to and parallel the arc traveled by the face of a golf club when properly swung.

7. The golf swing alignment training device of claim 6 wherein said club face orientation member has a T shape.

8. The golf swing alignment training device of claim 6 further comprising marking devices changeably applied to said stance rule member, wherein said marking devices are chosen from the class consisting of removable ink marks, pieces of tape and removable stickers, whereby the proper positioning of said feet by a particular golfer using a particular club can be indicated.

9. The golf swing alignment training device of claim 8 further comprising marking devices changeably applied to said connecting shaft member, wherein said marking devices are chosen from the class consisting of removable ink marks, pieces of tape and removable stickers, whereby said marking devices can be applied as necessary to indicate the proper stance of a particular golfer using a particular club.

10. The golf swing alignment training device of claim 8 further comprising a golf ball position indicator member fastened to said swing guide member.

11. The golf swing alignment training device of claim 1 wherein said upper edge of said elongated swing guide member is contoured to substantially trace the furrow produced through the grass by the golf club when a skilled golfer strikes a golf ball placed directly on the grass.

12. The golf swing alignment training device of claim 11 wherein said downswing end of said elongated swing guide is rounded, whereby said elongated swing guide member is less likely to be damaged if struck by a golf club.

* * * * *